US011768051B2

(12) United States Patent
Egerdee et al.

(10) Patent No.: US 11,768,051 B2
(45) Date of Patent: Sep. 26, 2023

(54) TRIGGER ASSEMBLY FOR A CROSSBOW

(71) Applicant: Excalibur Crossbow, Inc., Eugene, OR (US)

(72) Inventors: Kyle William Egerdee, Fergus (CA); Stephen Donald Langdon, Arthur (CA); Cole J. Jessup, Waterloo (CA); Robert G. Dykeman, Moffat (CA)

(73) Assignee: EXCALIBUR CROSSBOW, LLC, Eugene, OR (US)

( * ) Notice: Subject to any disclaimer, the term of this patent is extended or adjusted under 35 U.S.C. 154(b) by 0 days.

(21) Appl. No.: 17/472,918

(22) Filed: Sep. 13, 2021

(65) Prior Publication Data

US 2021/0404762 A1 Dec. 30, 2021

Related U.S. Application Data

(62) Division of application No. 16/835,249, filed on Mar. 30, 2020, now Pat. No. 11,143,482.

(51) Int. Cl.
*F41B 5/12* (2006.01)

(52) U.S. Cl.
CPC ..... *F41B 5/126* (2013.01)

(58) Field of Classification Search
CPC .. F41B 5/12; F41B 5/123; F41B 5/126; F41B 5/14; F41B 5/1403; F41A 17/28; F41A 17/46
USPC ..... 124/25, 31, 40
See application file for complete search history.

(56) References Cited

U.S. PATENT DOCUMENTS

| | | | | |
|---|---|---|---|---|
| 1,542,159 | A | 6/1925 | Maxwell | |
| 2,484,589 | A | 10/1949 | Richards | |
| 2,786,461 | A | 3/1957 | Pelsue, Jr. | |
| 2,997,998 | A * | 8/1961 | Traise | F41B 7/043 124/28 |
| 3,043,287 | A | 7/1962 | Nelson | |
| 3,561,419 | A | 2/1971 | Cuzuzza, Sr. | |
| 3,670,711 | A | 6/1972 | Firestone | |

(Continued)

OTHER PUBLICATIONS

Lacas Crossbows; "Homemade double crossbow 2x120 lbs"; May 30, 2015; video screenshots provided; video at https:1/youtu.be/qXMDXe_Cbvl.

(Continued)

*Primary Examiner* — Alexander R Niconovich
(74) *Attorney, Agent, or Firm* — Husch Blackwell LLP

(57) ABSTRACT

A multiple-shot crossbow includes a mainframe, a riser, upper and lower bow limbs and bowstrings, and a trigger mechanism. The mainframe includes upper and lower rails, each for supporting and guiding a corresponding bolt. The riser includes a passage for accommodating loading and launching a bolt. The bow limbs are attached to the riser and the bowstrings are attached to the bow limbs. Each bowstring is arranged independently to be drawn from a brace position to a drawn position and then return to the brace position while launching a bolt positioned on the corresponding rail. The lower bowstring is movable within a longitudinal slot between the upper and lower rails. The trigger mechanism is attached to a rear end of the mainframe and includes upper and lower trigger portions, each retaining a corresponding drawn bowstring and then releasing it upon actuation by a user.

12 Claims, 10 Drawing Sheets

(56) References Cited

U.S. PATENT DOCUMENTS 3,741,190 A * 6/1973 Lopez ..... F41B 7/04 124/31
3,749,076 A 7/1973 Suski et al.
4,134,369 A 1/1979 Cook
4,544,163 A 10/1985 Scanlon
4,593,675 A 6/1986 Waiser
4,603,676 A 8/1986 Luoma
4,649,892 A 3/1987 Bozek
4,697,571 A 10/1987 Waiser
4,719,897 A 1/1988 Gaudreau
4,942,861 A 7/1990 Bozek
5,085,200 A * 2/1992 Horton-Corcoran ..... F41B 5/1469 124/40
5,115,795 A 5/1992 Farris
5,220,906 A 6/1993 Choma
5,372,118 A * 12/1994 Schmidt, III ..... A01K 81/00 124/20.3
5,437,260 A * 8/1995 King ..... F41B 5/12 124/25.5
5,439,231 A 8/1995 Roberts et al.
5,598,829 A * 2/1997 Bednar ..... F41B 5/12 124/40
5,649,520 A * 7/1997 Bednar ..... F41B 5/12 124/40
5,803,843 A 9/1998 Anderson et al.
5,823,172 A 10/1998 Suggitt
5,884,614 A 3/1999 Darlington et al.
6,095,128 A 8/2000 Bednar
6,205,990 B1 3/2001 Adkins
6,286,496 B1 9/2001 Bednar
6,708,683 B1 * 3/2004 Harris ..... F41B 7/04 124/20.3
6,736,123 B1 * 5/2004 Summers ..... F41B 5/1469 124/40
6,799,566 B1 10/2004 Malucelli
6,802,304 B1 * 10/2004 Chang ..... F41B 5/123 124/40
6,868,845 B1 * 3/2005 Moore ..... F41B 5/10 124/25
6,913,007 B2 7/2005 Bednar
6,953,034 B2 * 10/2005 May ..... A01K 81/00 124/20.3
7,100,590 B2 9/2006 Chang
7,588,022 B2 * 9/2009 Chang ..... F41B 5/123 124/40
7,770,567 B1 * 8/2010 Yehle ..... F41A 17/46 124/40
7,784,453 B1 8/2010 Yehle
8,091,540 B2 * 1/2012 Matasic ..... F41B 5/12 124/31
8,104,461 B2 1/2012 Kempf
8,240,299 B2 8/2012 Kronengold et al.
8,443,790 B2 5/2013 Pestrue
8,453,631 B1 6/2013 Kronengold et al.
8,499,753 B2 8/2013 Bednar et al.
8,522,761 B1 * 9/2013 Chu ..... F41A 17/46 124/40
8,578,917 B2 11/2013 Bednar et al.
8,622,855 B2 1/2014 Bednar et al.
8,845,464 B1 9/2014 Hyde
8,899,217 B2 12/2014 Islas
8,950,385 B1 2/2015 Khoshnood
9,004,053 B1 * 4/2015 Anderson ..... F41B 5/12 124/31
9,010,308 B1 4/2015 Hyde et al.
9,028,347 B2 5/2015 Pedersen
9,074,837 B2 7/2015 Bednar et al.
9,140,516 B1 9/2015 Hyde
9,255,754 B1 * 2/2016 Kempf ..... F41B 5/12
9,303,944 B2 4/2016 Barber
9,341,432 B1 5/2016 Wohleb
9,341,434 B2 5/2016 McPherson et al.
9,354,018 B2 * 5/2016 Khoshnood ..... F41A 19/06
9,383,159 B2 7/2016 Pulkrabek et al.
9,404,706 B2 8/2016 Khoshnood
9,435,605 B2 * 9/2016 McPherson ..... F41B 5/12
9,441,925 B1 9/2016 Palomaki et al.
9,453,700 B2 9/2016 Bednar et al.
9,470,486 B2 10/2016 Bednar et al.
9,494,380 B1 * 11/2016 Yehle ..... F41A 17/46
9,506,715 B2 * 11/2016 Hughes ..... F41B 7/046
9,528,792 B1 12/2016 Chang
9,551,544 B1 1/2017 Kempf
9,557,134 B1 1/2017 Yehle
9,568,269 B1 * 2/2017 Chang ..... F41B 5/126
9,726,454 B2 * 8/2017 McPherson ..... F41B 5/12
9,733,041 B2 * 8/2017 Khoshnood ..... F41B 5/1469
9,759,513 B2 9/2017 Bednar et al.
9,909,832 B2 * 3/2018 Darlington ..... F41B 5/12
9,958,232 B1 5/2018 Egerdee et al.
10,012,468 B1 * 7/2018 Kempf ..... F21V 33/008
10,030,948 B2 7/2018 Bednar et al.
10,119,796 B2 11/2018 Bednar et al.
10,274,281 B2 * 4/2019 Chu ..... F41A 19/06
10,393,484 B2 8/2019 Bednar et al.
10,508,884 B1 * 12/2019 Chen ..... F41A 17/46
10,718,589 B2 * 7/2020 Zou ..... F41B 5/126
10,883,806 B2 1/2021 Bednar et al.
11,015,892 B1 * 5/2021 Jessup ..... F41A 17/20
11,085,721 B1 * 8/2021 Liu ..... F41B 5/12
11,320,231 B2 * 5/2022 Williams ..... F41B 5/12
2002/0059924 A1 5/2002 Bednar
2004/0194771 A1 10/2004 Malucelli
2005/0022799 A1 2/2005 Bednar
2006/0086346 A1 4/2006 Middleton
2006/0144380 A1 7/2006 Kempf
2006/0169258 A1 8/2006 Chang
2007/0137630 A1 6/2007 Simo et al.
2010/0170488 A1 7/2010 Rasor et al.
2013/0098343 A1 * 4/2013 Grace ..... F41B 5/123 124/25
2019/0331453 A1 * 10/2019 Zou ..... F41B 5/126
2020/0224993 A1 7/2020 Egerdee et al.
2020/0292271 A1 * 9/2020 Williams ..... F41B 5/126
2021/0123710 A1 4/2021 Bednar et al.
2021/0164753 A1 * 6/2021 Williams ..... F41B 5/1469

OTHER PUBLICATIONS

Lacas Crossbows; "Homemade double crossbow making"; Nov. 22, 2015; video screenshots provided; video at https://youtu.be/Em1CrcPcWlo.

Lacas Crossbows; "Double crossbow 6 arrow shooting"; Dec. 29, 2018; video screenshots provided; video at https://youtu.be/FtpZvdkQXcM.

* cited by examiner

TRIGGER ASSEMBLY FOR A CROSSBOW

CROSS-REFERENCE TO RELATED APPLICATIONS

This Application is a Divisional of and claims priority to U.S. patent application Ser. No. 16/835,249 filed Mar. 30, 2020, to Kyle William Egerdee et al., entitled "Multiple-Shot Crossbow," currently pending, the entire disclosure, including the specification and drawings, of which is incorporated herein by reference.

FIELD OF THE INVENTION

The field of the present invention relates to crossbows. In particular, a crossbow is disclosed that can be loaded with multiple bolts and can fire the multiple bolts in rapid succession.

SUMMARY OF THE INVENTION

An inventive multiple-shot crossbow includes a mainframe, a riser, upper and lower pairs of bow limbs, upper and lower bowstrings, and a trigger mechanism. The mainframe includes substantially parallel upper and lower longitudinal rails, with each rail including a corresponding longitudinal groove. Each groove supports a corresponding bolt positioned on the corresponding rail with one vane of its fletching received within the groove, and guides the corresponding bolt as it is launched from the crossbow. The riser is attached to a front end of the mainframe, and includes a longitudinal passage that enables a bolt to be inserted through the riser passage, positioned on the lower rail, and subsequently launched from the crossbow. The upper and lower pairs of bow limbs are attached to the riser, and the corresponding upper and lower bowstrings are attached to the upper and lower bow limbs, respectively. Each bowstring is arranged independently to be drawn from a brace position to a drawn position while deforming the corresponding bow limbs, and then return to the corresponding brace position while launching a bolt positioned on the corresponding rail. The lower bowstring is movable within a longitudinal slot between the upper and lower rails. The trigger mechanism is attached to a rear end of the mainframe and includes (i) an upper trigger portion that retains the drawn upper bowstring and then releases it upon actuation by a user, and (ii) a lower trigger portion that retains the drawn lower bowstring and then releases it upon actuation by the user. The inventive multiple-shot crossbow can further include various additional or alternative arrangements of the mainframe, riser, bow limbs, bowstrings, or trigger mechanism.

Objects and advantages pertaining to multiple-shot crossbows may become apparent upon referring to the example embodiments illustrated in the drawings and disclosed in the following written description or appended claims.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Figure 1:
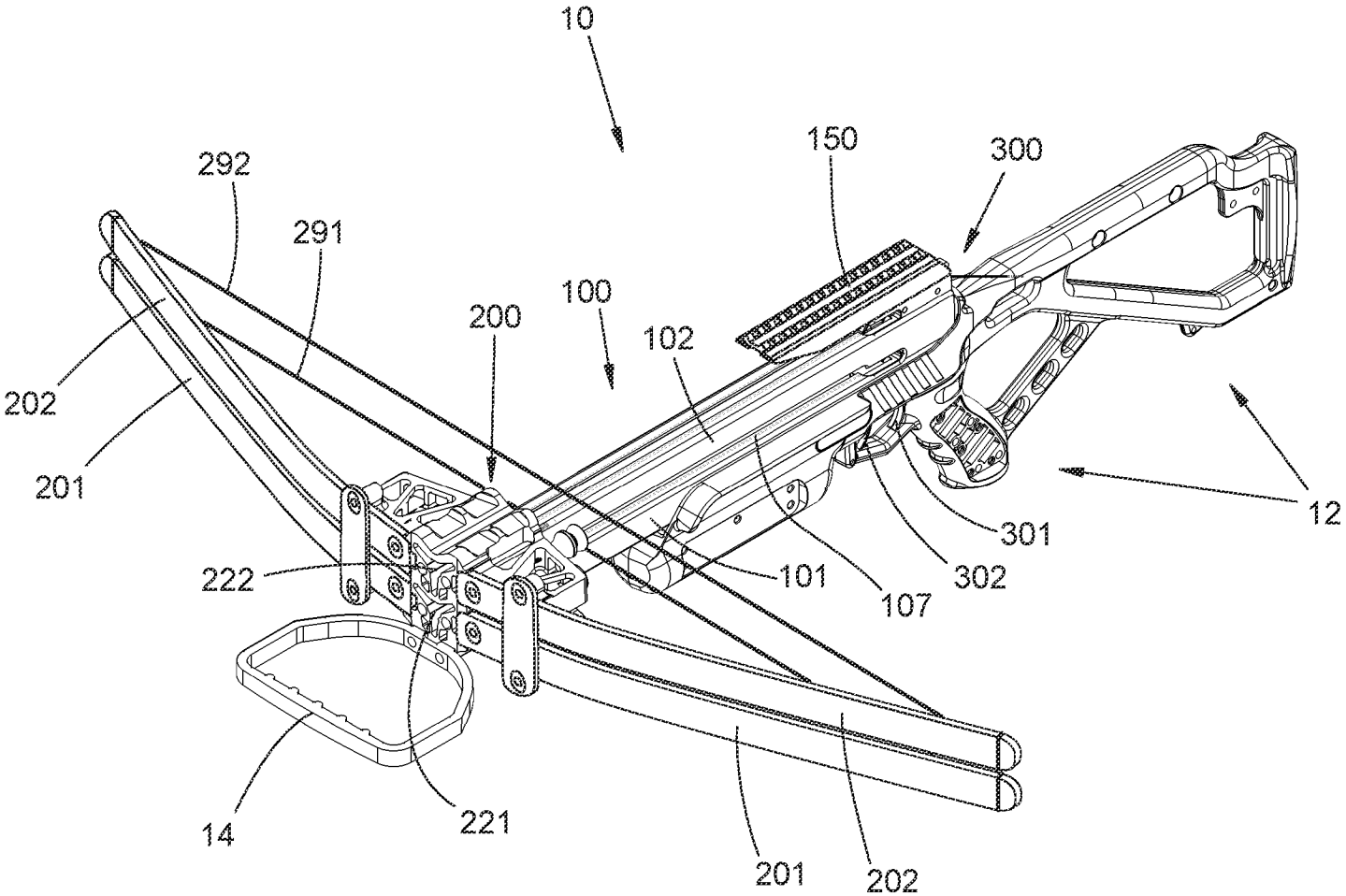
FIG. 1 is a perspective view of an example of a multiple-shot crossbow at brace, i.e., in an undrawn or rest position.
Figure 2:
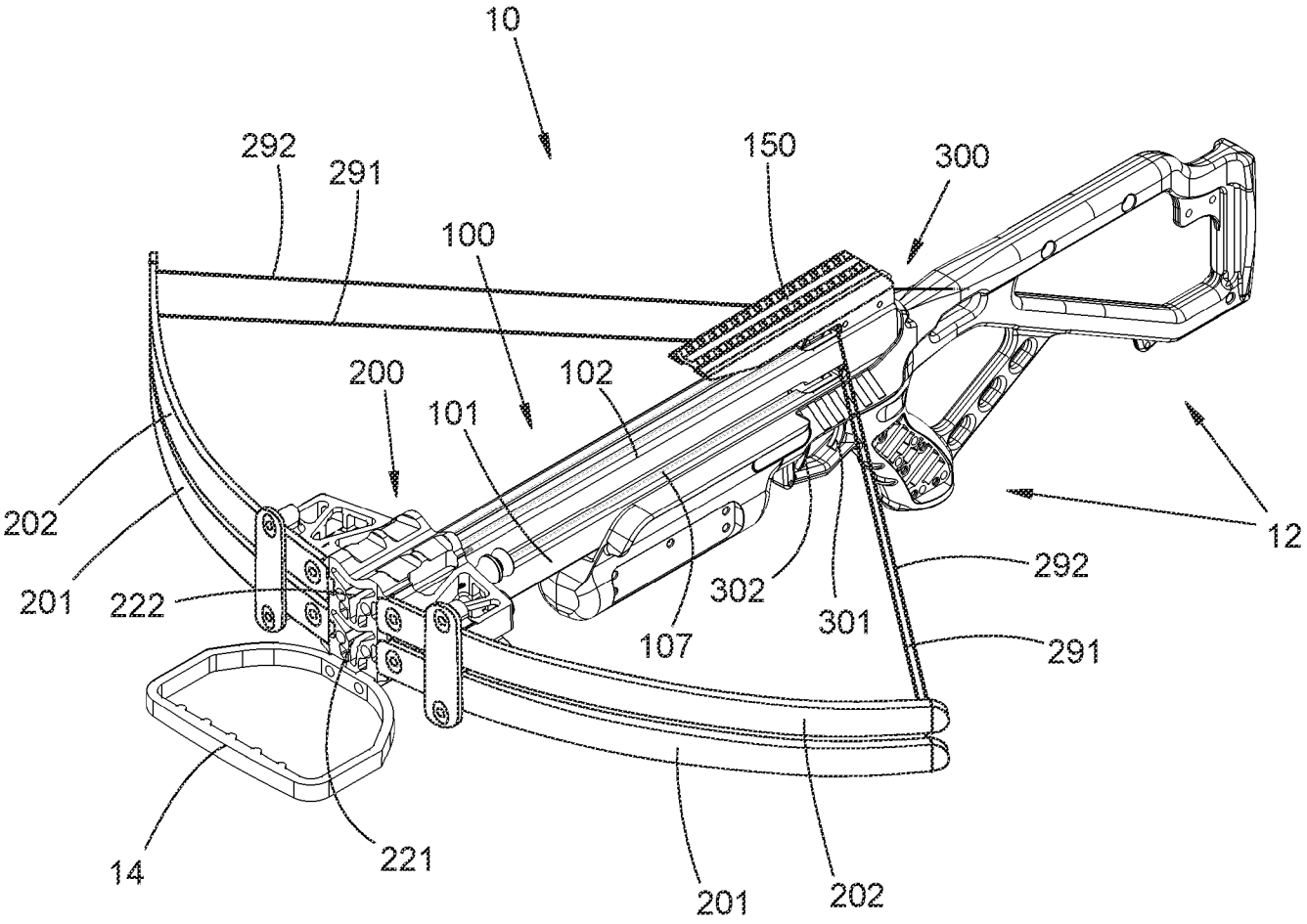
FIG. 2 is a perspective view of the example multiple-shot crossbow of FIG. 1 in a drawn position, before any bolt has been positioned on any rail.
Figure 3A:
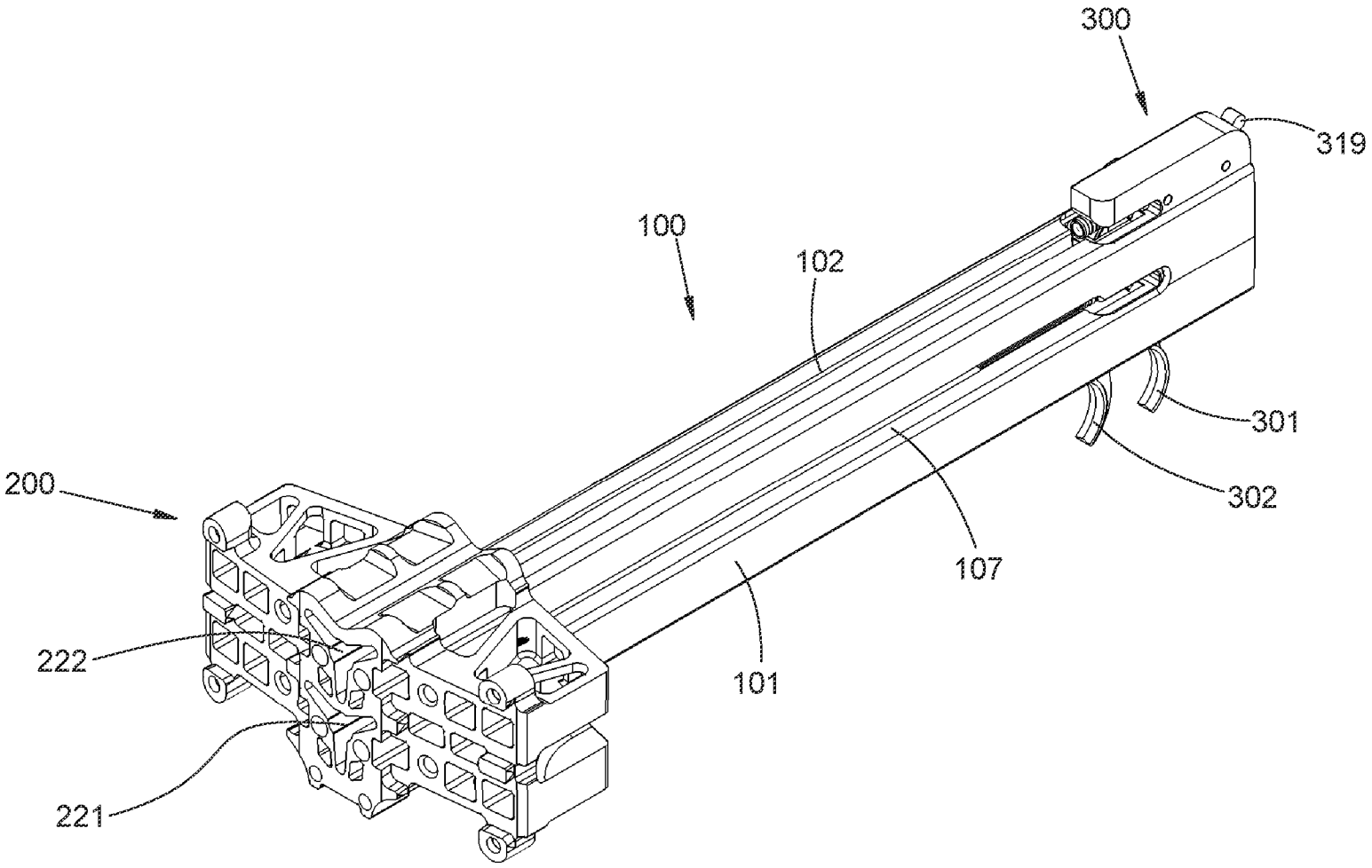
FIGS. 3A and 3B are perspective and side views, respectively, of the riser, mainframe, and trigger mechanism of the example multiple-shot crossbow of FIG. 1.
Figure 3B:
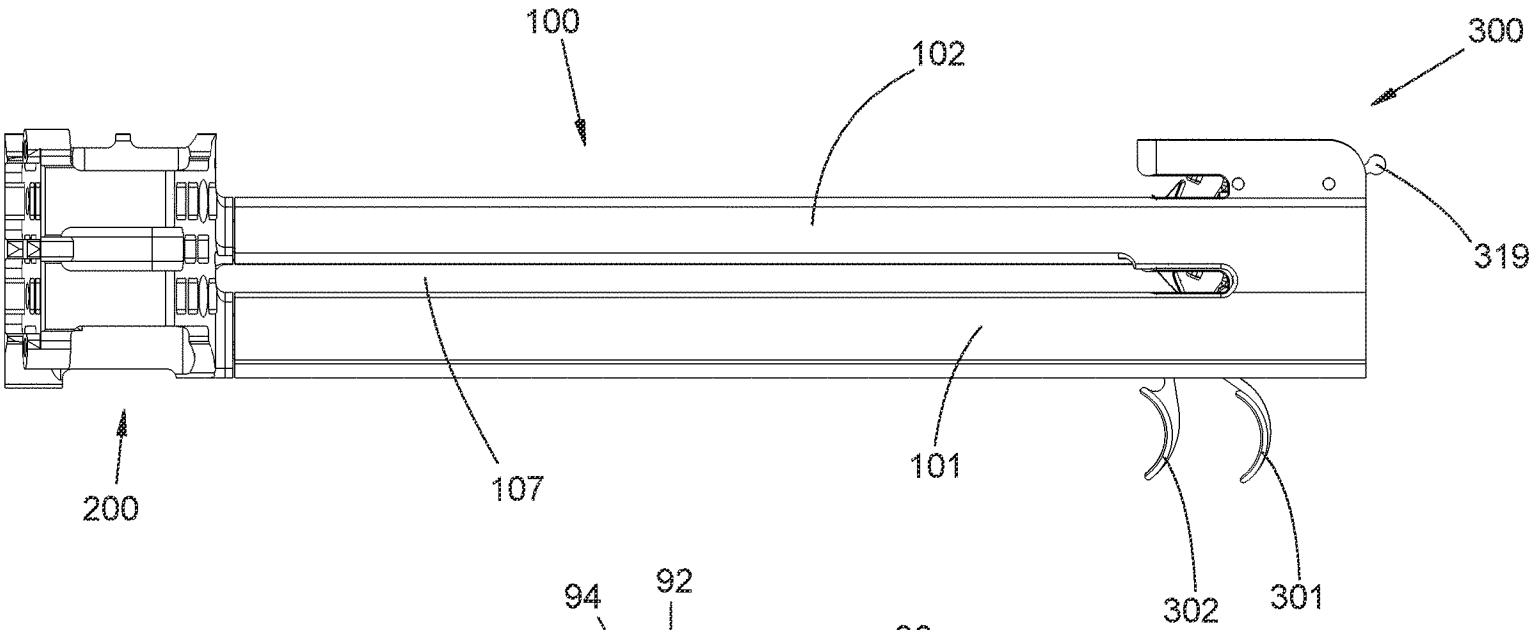

The embodiments depicted are shown only schematically; all features may not be shown in full detail or in proper proportion; for clarity certain features or structures may be exaggerated or diminished relative to others or omitted entirely; the drawings should not be regarded as being to scale unless explicitly indicated as being to scale. The embodiments shown are only examples and should not be construed as limiting the scope of the present disclosure or appended claims.

DETAILED DESCRIPTION OF EMBODIMENTS

In the following description and claims, the terms "upper" and "lower" are used to denote various elements of the multiple-shot crossbow. Referring to portions of the mainframe, the riser, the bow limbs, and the bowstrings, those terms typically are both spatial as well as functional, e.g., with the crossbow held in its usual orientation for launching a bolt, the upper rail is above the lower rail, the upper bowstring is above the lower bowstring, and so on. Referring to the trigger mechanism and its various constituent elements, however, those terms are functional but not necessarily spatial, e.g., the upper string catch is above the lower string catch, but the upper trigger actuator (which is coupled functionally to the upper sear and upper string catch to release the drawn upper bowstring and launch a bolt from the upper rail) is not necessarily above the lower trigger actuator (which is coupled functionally to the lower sear and lower string catch to release the drawn lower bowstring and launch a bolt from the lower rail).

An example of an inventive multiple-shot crossbow 10 is shown in FIGS. 1 through 6. The crossbow 10 includes a mainframe 100, a riser 200, upper bow limbs 202, lower bow limbs 201, an upper bowstring 292, a lower bowstring 291, and a trigger mechanism 300. The crossbow 10 typically can include a stock 12 or any suitable type or arrangement, usually attached to a bottom portion of the mainframe 100 and extending downward and rearward from the mainframe 100. In some examples a stirrup 14 can be attached to the riser 200 to assist with manual drawing of the crossbow 10. In some examples the crossbow 10 can include a draw mechanism of any suitable type or arrangement, including such elements as a crank, a cable or chain, gears or pulleys, a clutch or a brake, and so forth. The crossbow 10 is shown at brace in FIG. 1 and drawn in FIG. 2 (but with no bolts loaded).

The mainframe 100 includes a lower rail 101 and an upper rail 102. In many examples the lower rail 101 includes a longitudinal groove 103 on its top surface and the upper rail 102 includes a longitudinal groove 104 on its top surface (e.g., as in FIG. 4B). The rails 101/102 are arranged one above the other with a longitudinal slot 107 between them that extends transversely through the mainframe 100. The rails 101/102 typically are secured together at the front and back ends of the slot 107, e.g., by being attached to one another, integrally formed together as a unitary structure, both attached to the riser 200, both attached to the stock 12, or in any other suitable way. In the examples shown the rearward portions of the rails 101/102 are attached to each other while forward portions of the rails 101/102 are each attached to the riser 200. Each rail 101/102 is arranged to support a bolt 91/92 positioned thereon and to guide the corresponding bolt 91/92 as it is launched from the crossbow 10. Each groove 103/104 (if present) receives one vane of the bolt's fletching 95/96 therein, so that the shaft 93/94 of the bolt 91/92 can rest on the corresponding rail 101/102. In many examples the arrangement of each rail 101/102 and its corresponding groove 103/104 described above is similar to the arrangement of a single rail and groove of a conventional, single-shot crossbow.

A riser 200 is attached to a front end of the mainframe 100. A lower pair of bow limbs 201 and an upper pair of bow limbs 202 are attached to the riser 200. Corresponding lower and upper bowstrings 291/292 are attached to the lower and upper bow limbs 201/202, respectively. The bow limbs 201/202 and the bowstrings 291/292 are arranged so that each bowstring 291/292 can move independently between corresponding brace and drawn positions. Each bowstring 291/292 can be drawn from its brace position (i.e., its resting position before the bow is drawn) to its drawn position while deforming the corresponding bow limbs 201/202. Each drawn bowstring 291/292 is held in its drawn position by a corresponding portion of the trigger mechanism 300, and then released upon actuation of that corresponding portion of the trigger mechanism 300 (described further below). Upon release, each bowstring 291/292 returns to its brace position (under the impetus of the deformed bow limbs 201/202 returning to their shapes at brace) and thereby launches a bolt positioned on the corresponding rail 101/102. The mainframe 100 includes a longitudinal slot 107 that passes through the mainframe 100 between the lower and upper rails 101/102; the lower bowstring 201 is movable between its brace and drawn positions within the longitudinal slot 107.

Figure 5:
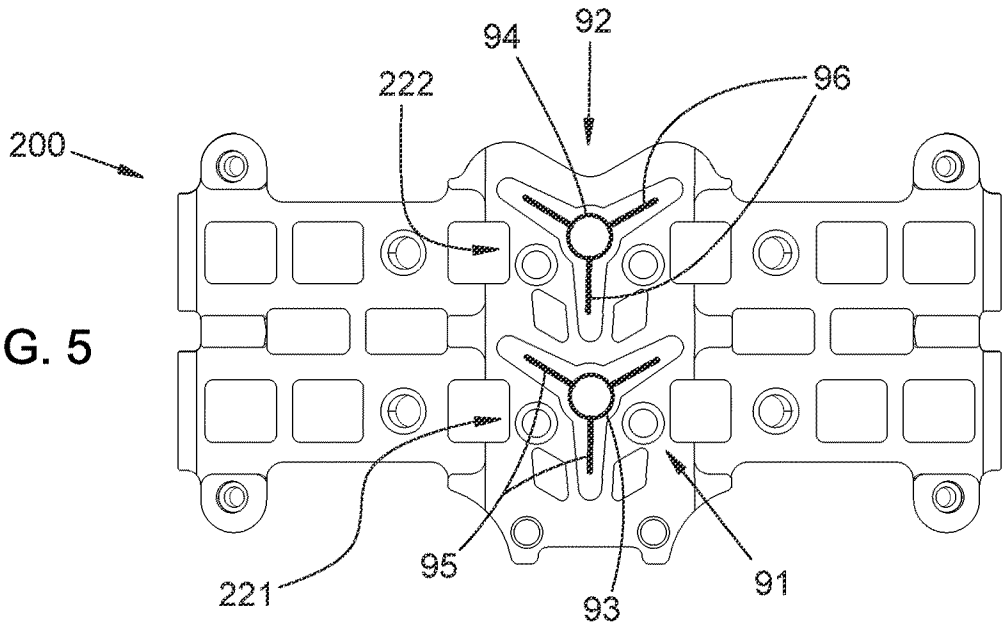
FIG. 5 is a front view of the riser of the example multiple-shot crossbow of FIG. 1, including bolts positioned for passing through the upper and lower riser passages.
Figure 4A:
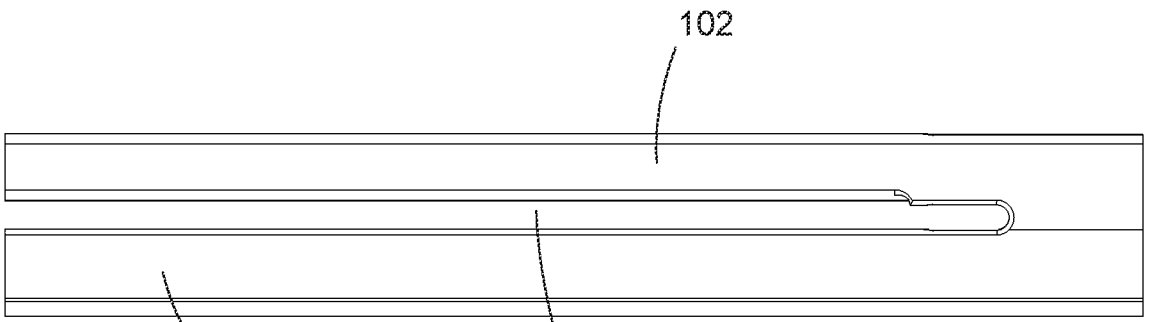
FIGS. 4A and 4B are front and side views of the mainframe of the example multiple-shot crossbow of FIG. 1; those views are not to scale. The front view includes bolts positioned on the upper and lower rails.
Figure 4B:
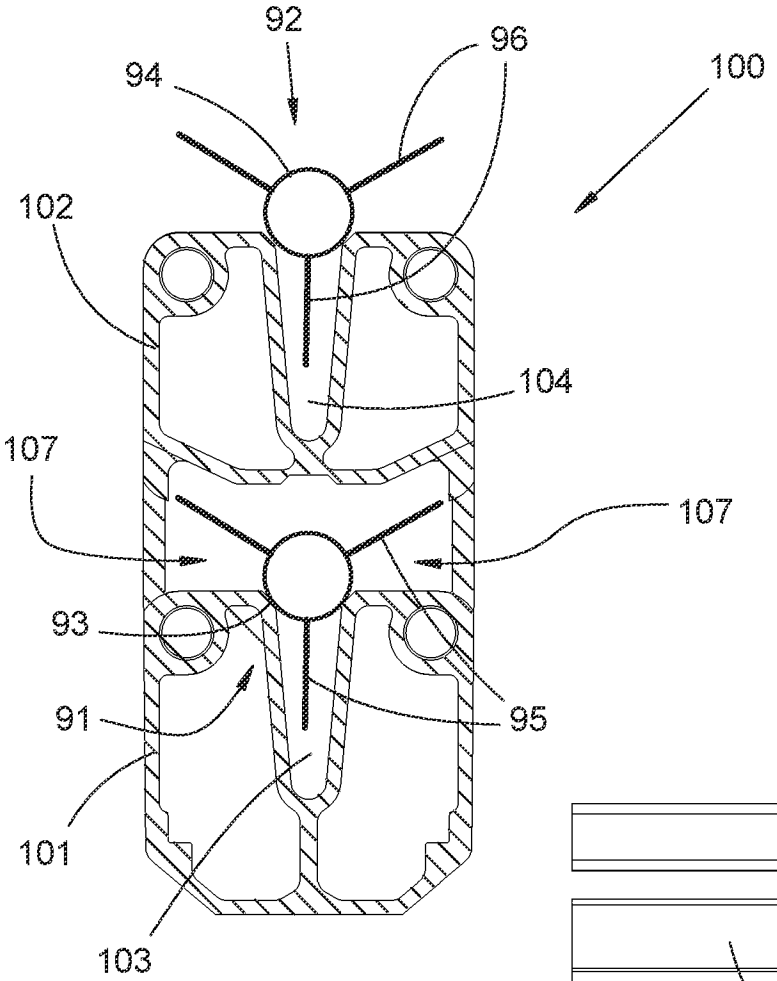

The riser 200 includes a longitudinal riser passage 221 that passes through the riser 200 (e.g., as in FIG. 5). The riser passage 221 is arranged so that a bolt 91 can be inserted through the riser passage 221, positioned on the lower rail 101, and subsequently launched from the crossbow 10. In some examples the riser passage 200 can include a central hole (to accommodate a shaft 93 of the bolt 91 inserted through the riser passage 200) and three radial slots (to accommodate the fletching 95 of the bolt 91). The interior of the slot 107 and the riser passage 221 together form a somewhat enclosed, barrel-like chamber for a bolt 91 positioned on the lower rail 101. In some examples the riser 200 can include includes an upper longitudinal riser passage 222 that passes through the riser 200. That additional, upper riser passage 222 is arranged so that a bolt 92 can be inserted through the upper riser passage, positioned on the upper rail 102, and subsequently launched from the crossbow 10. In examples that include an upper riser passage 222, it can include a central hole and three radial slots to accommodate the shaft 94 and fletching 96, respectively, of a bolt 92 positioned on the upper rail 102. Such an upper riser passage 222 can be employed, e.g., in examples wherein greater strength or stiffness of the riser 200 is needed or desired. In some examples, the mainframe 100 can include an enclosure (not shown) above the upper rail 102. Such an enclosure is arranged so as to leave a longitudinal slot between the enclosure and the upper rail 102, forming a somewhat enclosed, barrel-like chamber for a bolt 92 positioned on the upper rail 102. In such examples, the upper bowstring 202 is movable between its brace and drawn positions within the longitudinal slot between the enclosure and the upper rail 102.

The trigger mechanism 300 is attached to a rear end of the mainframe 100. The trigger mechanism can be housed within a rearward portion of the mainframe 100, within its own housing 330 attached to the mainframe 100, or partly in each of those. An upper trigger portion retains the upper bowstring 292 in its drawn position, and releases, upon actuation by a user, the upper bowstring 292 to return to its brace position. Similarly, a lower trigger portion retains the lower bowstring 291 in its drawn position, and releases, upon actuation by the user, the lower bowstring 291 to return to its brace position. The trigger mechanism 300, and the upper and lower trigger portions thereof, can be of any suitable type or arrangement.

In some examples (e.g., as in FIG. 6 or FIGS. 7A/7B/7C; each rotation axis is marked with an "X"), (i) the lower trigger portion can include a lower trigger actuator 301, a lower sear 307, and a lower string catch 311, and (ii) the upper trigger portion can include an upper trigger actuator 302, an upper sear 308, and an upper string catch 312. Each string catch 311/312 is movable between corresponding retention and release positions and biased toward the corresponding release position (biased clockwise in the examples shown). While in its corresponding retention position, each string catch 311/312 retains the corresponding drawn bowstring 291/292 against tension exerted by the corresponding deformed bow limbs 201/202; upon biased movement to its corresponding release position, each string catch 311/312 releases the corresponding drawn bowstring 291/292, which then returns to its brace position propelled by the corresponding deformed bow limbs 201/202. Each sear 307/308 is movable between corresponding firing and non-firing positions and biased toward the corresponding non-firing position (biased counterclockwise in the examples shown). While in its corresponding non-firing position, each sear 307/308 holds the corresponding string catch 311/312 in its corresponding retention position; upon movement to its corresponding firing position (against its bias, urged by the corresponding trigger actuator 301/302), each sear 307/308 permits biased movement of the corresponding string catch 311/312 to its corresponding release position. Each trigger actuator 301/302 is movable between corresponding actuating and non-actuating positions. Each trigger actuator 301/302 is linked to the corresponding sear 307/308 so as to move the corresponding sear to the corresponding firing position upon movement from the corresponding non-actuated position to the corresponding actuated position. In some examples, including that shown in the drawings, each trigger actuator 301/302 is linked to the corresponding sear 307/308 by a corresponding linkage 305/306; in other examples (not shown) each trigger 301/302 is linked directly to the corresponding sear 307/308. Bias on each sear 307/308 toward its corresponding non-firing position also biases the corresponding trigger actuator 301/302 toward its corresponding non-actuated position.

In some examples (including the examples of FIGS. 6 and 7A/7B/7C), each of the upper and lower portions of the trigger mechanism 300 can be actuated independently of the other. Such independent actuation enables the corresponding drawn bowstrings 291/292 to be released, and the bolts 91/92 positioned on the corresponding rails 101/102 to be launched, independently of one another by actuating the corresponding trigger actuator 301/302 (i.e., by moving the corresponding trigger actuator 301/302 from its non-actuated position to its actuated position). In some examples (not shown), the trigger mechanism 300 can include only a single trigger actuator that acts as both of the upper and lower trigger actuators; alternatively, the lower and upper trigger actuators 301/302 can be coupled together to act as a single trigger actuator (e.g., by coupling together the linkages 305 and 306 in the examples of FIG. 6 or 7A/7B/7C). In some such examples, the trigger mechanism 300 can be arranged for only one of (i) release of the bowstrings 291/292 together in response to a single actuation of the single trigger actuator, (ii) release of the bowstrings 291/292 sequentially in response to a single actuation of the single trigger actuator, or (iii) release of the bowstrings 291/292 sequentially in response to two sequential actuations of the single trigger actuator. In some other such examples, the trigger mechanism 300 can be arranged so as to enable switching among two or more of those three arrangements. In some examples, the trigger mechanism 300 can be arranged for switching between (i) an arrangement that enables independent actuation of the trigger actuators 301/302 to release independently the corresponding bowstrings 291/292 in response to actuation of the corresponding trigger actuator 301/302, and (ii) an arrangement wherein the trigger actuators 301/302 are coupled together so as to enable release of both of the bowstrings 291/292 in response to actuation of either trigger actuator 301/302 (e.g., by providing a removable pin for coupling together the linkages 305/306 if desired, or to be removed if not desired).

A crossbow typically includes a safety mechanism to prevent inadvertent actuation of a trigger mechanism and release of a drawn bowstring. Typically the safety mechanism includes a mechanical stop or other element movable between a safety-on position (in which it obstructs movement of a trigger actuator to its actuated position, directly or by obstructing movement of a sear to its firing position) and a safety-off position (in which it permits movement of the trigger actuator to its actuated position and movement of the sear to its firing position). The safety mechanism typically is moved between its safety-off and safety-on positions manually by a user of the crossbow. In some examples of the multiple-shot crossbow 10, the trigger mechanism 300 can include a single safety mechanism, of any suitable type or arrangement, that is movable between (i) its safety-on position (that prevents any actuation of the trigger mechanism 300 to release any bowstring 291 or 292), and (ii) its safety-off position (that allows any actuation of the trigger mechanism 300 to release either or both of the bowstrings 291/292).

In other examples (e.g., as in FIG. 6 or FIGS. 7A/7B/7C), the trigger mechanism 300 can include lower and upper safety mechanisms 317/318 (arranged to block movement of the corresponding sears 307/308 in the examples shown; any suitable type or arrangement can be employed). In various examples, the trigger mechanism 300 can be arranged so that each safety mechanism 317/318 can be moved between its corresponding safety-on and safety-off positions (i) independently of the other, (ii) only in tandem with the other, or (iii) only in opposition to the other. In the first instance, there is no coupling between the safety mechanisms 317/318 (e.g., by removing or splitting the coupler 316 in the examples of FIG. 6 or FIGS. 7A/7B/7C, and providing each safety mechanism 317/318 with its own lever); each can move independently of the other, and can be in its safety-on or safety-off position independently of the other. In the second instance, the safety mechanisms 317/318 can be coupled together (by the coupler 316 in the examples of FIGS. 6 and FIGS. 7A/7B/7C, operated using the single lever 319) so that either: both safety mechanisms 317/318 are in their respective safety-off positions; or both safety mechanisms 317/318 are in their respective safety-on positions. In the third instance, the safety mechanisms 317/318 can be coupled together so that either: the safety mechanism 317 is in its safety-off position and the safety mechanism 318 is in its safety-on position; or the safety mechanism 317 is in its safety-on position and the safety mechanism 318 is in its safety-off position. The example of FIG. 6 can be altered to provide such operation, e.g., by moving the connection point of the coupler 316 on the safety mechanism 317 so that the safety mechanisms 317 and 318 counterrotate (instead of co-rotating as they do on FIG. 6). The example of FIGS. 7A/7B/7C can be altered to provide such operation, e.g., by suitably altering the position along the coupler 316 of one of the safety mechanisms 317/318.

Figure 6:
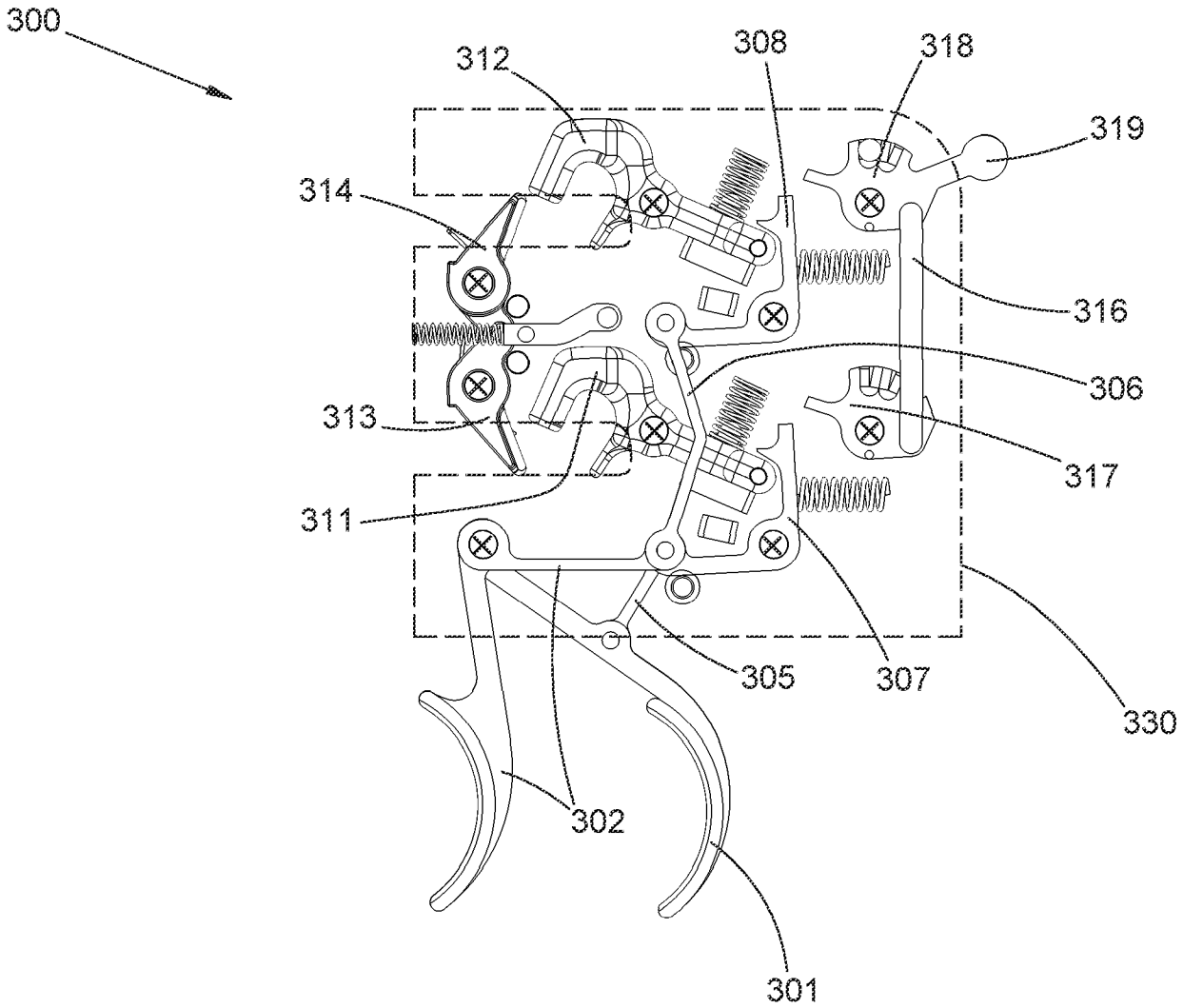
FIG. 6 is a side view of an example arrangement of the trigger mechanism for the multiple-shot crossbow.

A crossbow often includes a so-called anti-dry-fire mechanism to prevent dry firing of the crossbow (i.e., triggering the crossbow and releasing a drawn bowstring without a bolt present to be launched). Such dry firing can damage the crossbow and can be hazardous to the user of the crossbow and bystanders. In some examples of the multiple-shot crossbow 10, the trigger mechanism 300 can include lower and upper anti-dry-fire mechanisms of any suitable type or arrangement. In the example of FIG. 6, with the corresponding bowstring 219/292 drawn and no bolt positioned on the corresponding rail 101/102, a corresponding spring-biased string latch 313/314 is held by its bias force in its corresponding bolt-absent position, where it prevents movement of the corresponding bowstring 291/292 from its drawn position. With a bolt positioned on the corresponding rail 101/102, the corresponding string latch 313/314 is forced into its bolt-present position against its bias force, where it permits movement of the corresponding bowstring 291/292 from its drawn position to its brace position.

Figure 7A:
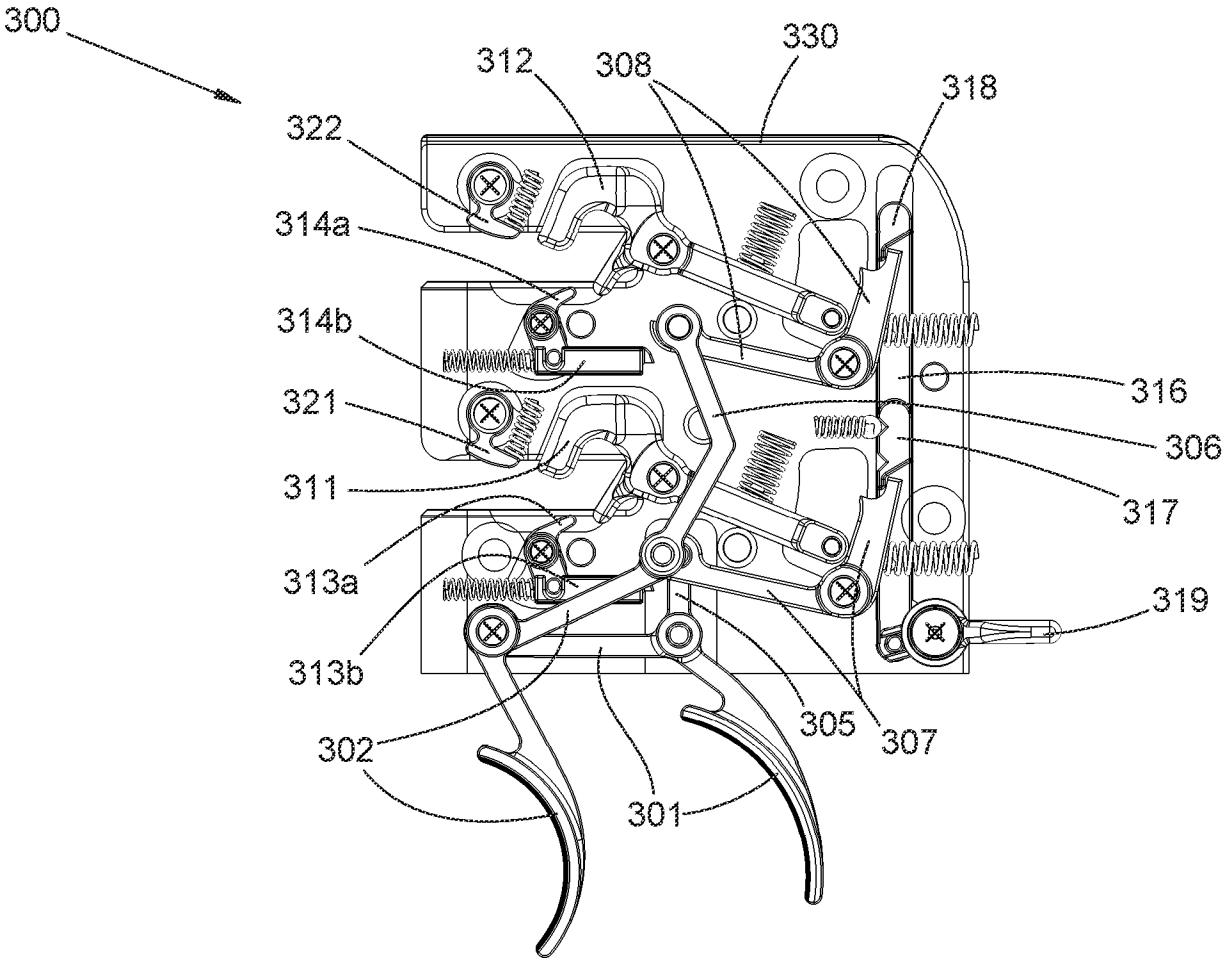
FIGS. 7A, 7B, and 7C are side views of another example arrangement of the trigger mechanism for the multiple-shot crossbow.
Figure 7B:
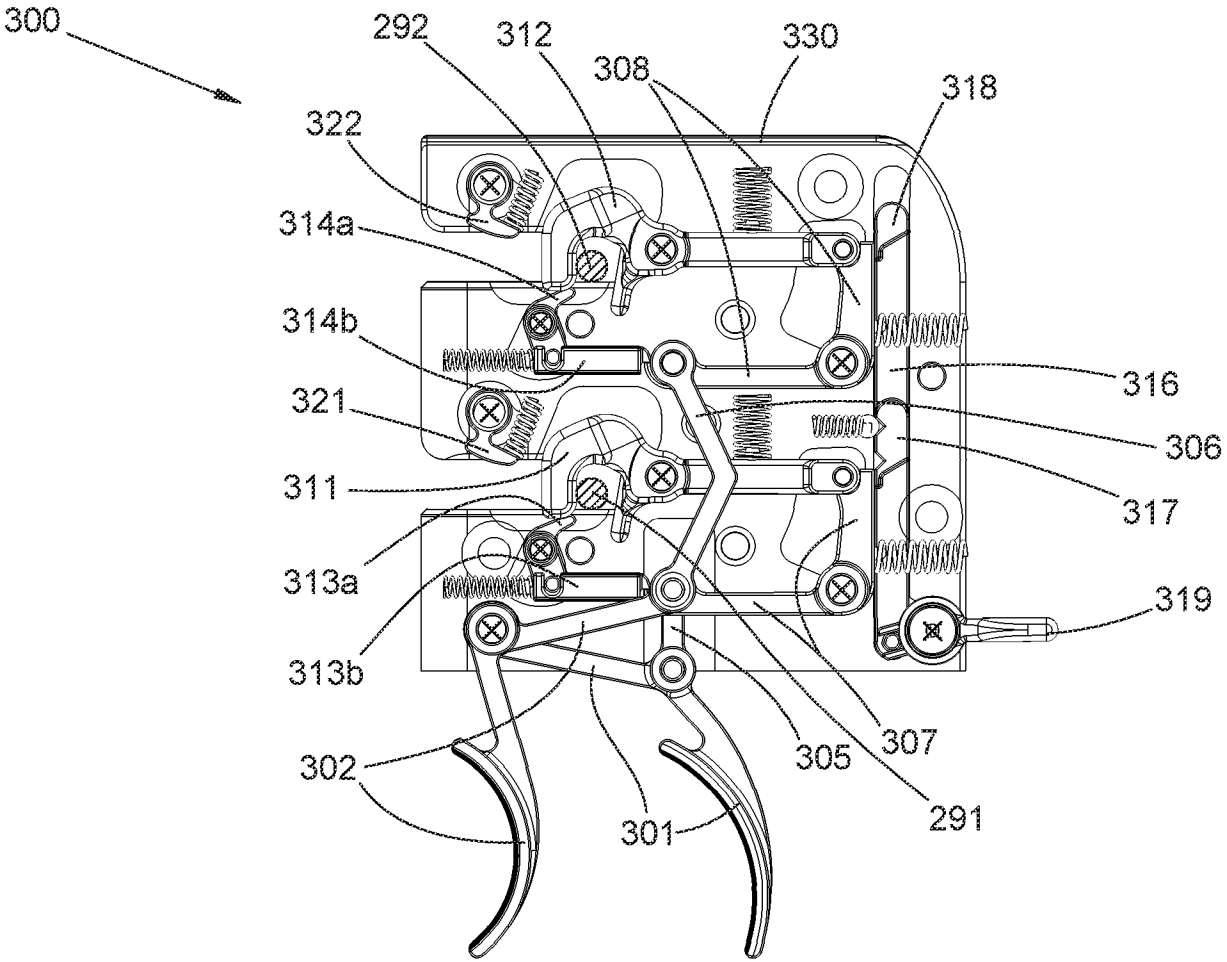
Figure 7C:
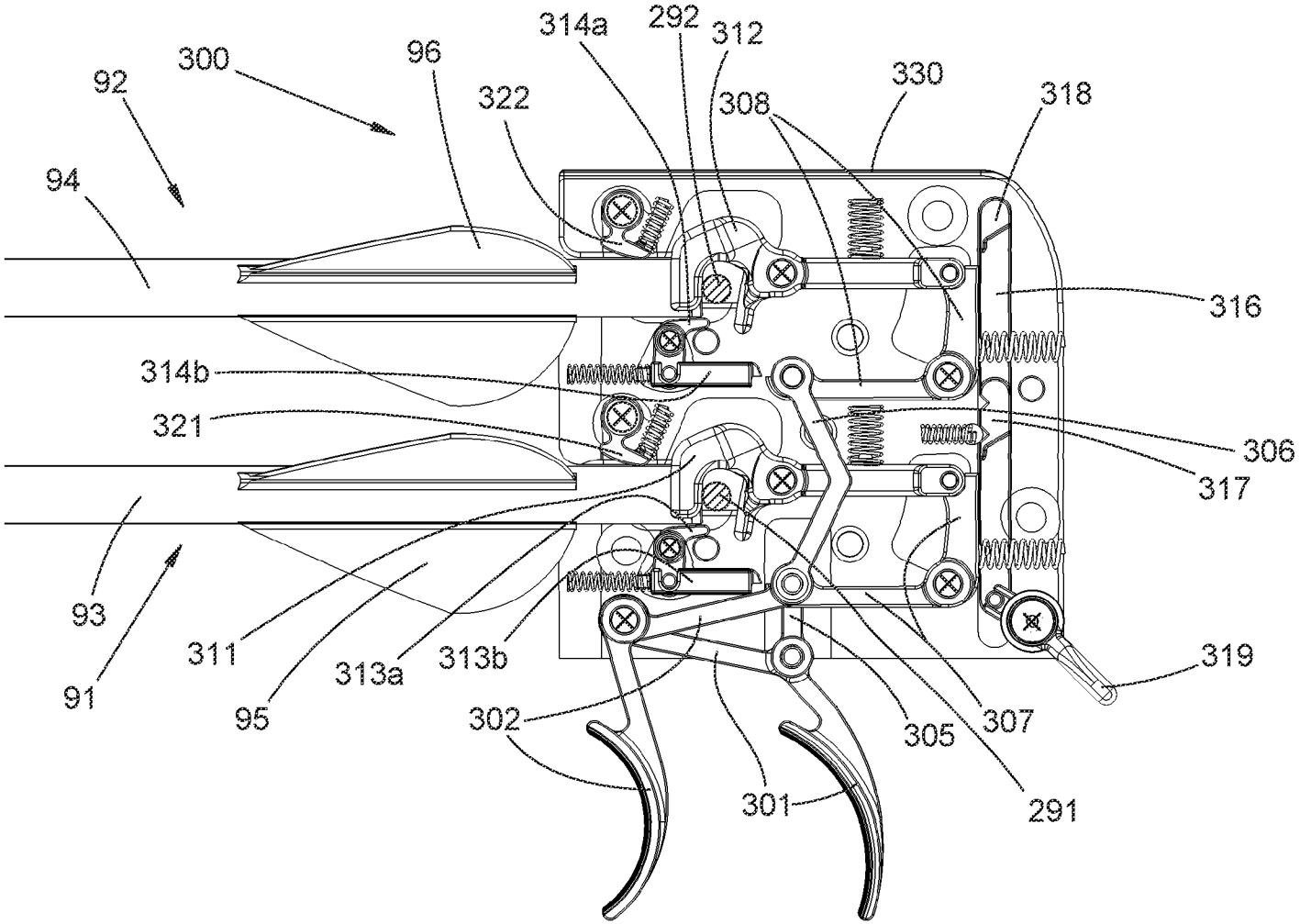
Figure 8:
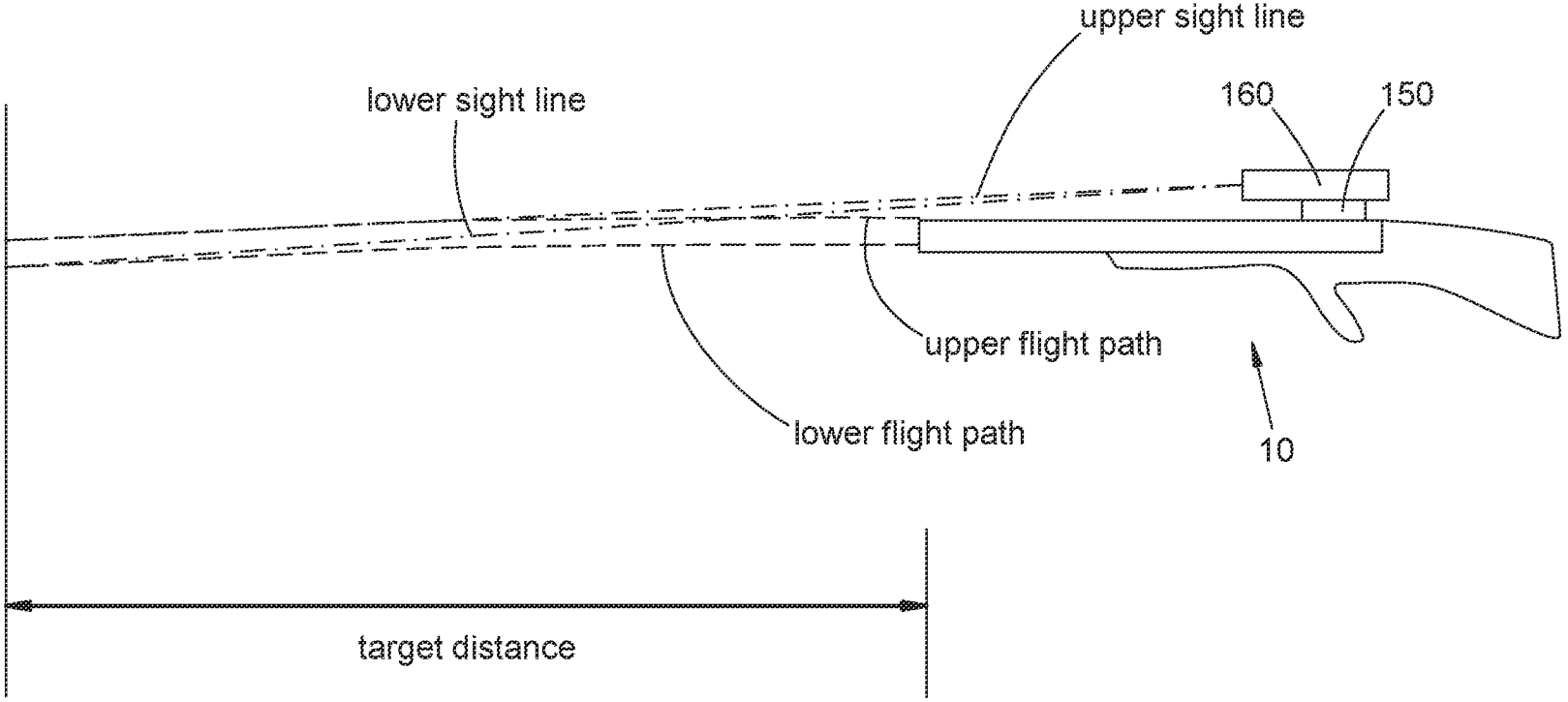
FIG. 8 illustrates schematically use of different upper and lower sight positions for aiming bolts fired from the upper and lower rails, respectively.

The example of FIGS. 7A/7B/7C incorporates an inventive anti-dry-fire mechanism into the each of the upper and lower trigger portions of the trigger mechanism 300. Each inventive anti-dry-fire mechanism includes a corresponding bolt sensor 313*a*/314*a* and a corresponding reciprocating sear latch 313*b*/314*b*. Each bolt sensor 313*a*/314*a* is coupled to the corresponding sear latch 313*b*/314*b*. With the corresponding bowstring 291/292 drawn and with no bolt is positioned on the corresponding rail 101/102 (as in FIG. 7B), the corresponding bolt sensor 313*a*/313*b* is in its bolt-absent position and the corresponding sear latch 314*a*/314*b* is held in its latched position by its bias force. In its latched position, the corresponding sear latch 314*a*/314*b* engages the corresponding sear 307/308 and prevents actuation of the corresponding trigger portion. With the corresponding bowstring 291/292 drawn and a corresponding bolt 91/92 positioned on the corresponding rail 101/102 (as in FIG. 7C), the bolt 91/92 holds the corresponding bolt sensor 313*a*/313*b* in its bolt-present position and in turn holds the corresponding sear latch 314*a*/314*b* in its unlatched position against its bias force. In its unlatched position, the corresponding sear latch 314*a*/314*b* is disengaged from the corresponding sear 307/308, thereby permitting actuation of the corresponding trigger portion to release the corresponding drawn bowstring 291/292 and launch the corresponding bolt 91/92 (returning the trigger mechanism 300 to the arrangement of FIG. 7A).

In some examples, each inventive anti-dry-fire mechanism can further include a corresponding biased bolt retainer 321/322. With a bolt 91/92 present on the corresponding rail 101/102, the corresponding bolt retainer 321/322 presses the bolt 91/92 against the corresponding bolt sensor 313*a*/314*a*. That arrangement can ensure that the presence of the bolt 91/92 is sufficient to hold the corresponding bolt sensor 313*a*/314*a* in its bolt-present position, indirectly against the bias force on the corresponding sear latch 313*b*/314*b*. That arrangement also can prevent one of the bolts 91/92 from being dislodged from the corresponding bolt sensor 313*a*/314*a* when the other bolt 91/92 is launched. In some examples, each bolt retainer 321/322 can be structurally arranged to frictionally engage the corresponding bolt 91/92 positioned on the corresponding rail 101/102. In some of those examples each bolt retainer 321/322 can include an engagement surface with rounded or beveled front and back portions that facilitate movement of the corresponding bolt 91/92 along the corresponding rail 101/102.

In addition to the inventive multiple-shot crossbow 10, the inventive anti-dry-fire mechanism described above can be employed in a crossbow having only one rail, one pair of limbs, one bowstring, and a single trigger mechanism. The reciprocating arrangement of the sear latch enables significant reduction of overall size relative to conventional anti-dry-fire mechanisms.

In some examples the crossbow 10 can include a mounting bracket 150 for a sight 160. The mounting bracket 150 can be attached to a rearward portion of the mainframe 100. Because the rails 101/102 are at different heights, their respective flight paths are also displaced vertically from one another (e.g., as illustrated schematically in FIG. 7). If the sight 160 is aligned optimally with respect to one flight path, it cannot also be optimally aligned with the other. Accordingly, the mounting bracket 150 can be arranged to be movable between defined upper and lower sight positions, typically at slightly different angles relative to the mainframe 100. The defined sight positions are selected so that with the mounting bracket 150 in, e.g., the lower sight position, optimal alignment of the sight 160 with respect to the flight path of a bolt 91 launched from the lower rail 101 results in equivalent alignment of the sight 160, with the mounting bracket 150 in the upper sight position, with respect to the flight path of a bolt 92 launched from the upper rail 102. In other words, "dialing in" the sight 160 for a bolt 91 on the lower rail 101, with the mounting bracket 150 in the lower position, results in the sight 160 being similarly "dialed in," after moving the mounting bracket to the upper position, for a bolt 92 on the upper rail 102. Conversely, "dialing in" the sight 160 for the bolt 92 on the upper rail 102, with the mounting bracket in the upper position, results in the sight 160 being similarly "dialed in," after moving the mounting bracket 150 to the lower position, for the bolt 91 on the lower rail 101. The closest equivalence of the upper and lower alignments occurs at only one target distance from the crossbow 10, but in many instances can be sufficiently close over a range of target distances. In some examples, difference between the upper and lower sight positions is fixed; in other examples the difference can be adjustable. The mounting bracket 150 of mainframe 110 can include an indexing structure, detent, stop, or other suitable mechanical arrangement to define the upper and lower sight positions for the mounting bracket 150. After shooting one of the bolts 91/92 with the mounting bracket 150 in the corresponding sight position, the user of the crossbow can quickly switch the sight 160 from one alignment to the other by moving the mounting bracket 150 to the other sight position before shooting the second of the bolts 91/92.

The crossbow 10 can include bow limbs 201/202 and bowstrings 291/292 of any suitable type or arrangement. In some examples (including those shown in the drawings) one or both pairs of bow limbs 201/202 can be simple, straight limbs (which become curved as they are deformed, e.g., when the bow is rigged or drawn). In some examples (not shown), one or both pairs of bow limbs 201/202 can be recurve limbs. In some examples (not shown), one or both pairs of limbs 201/202 can have corresponding rotatably mounted pulley members engaged with a corresponding bowstring 291/292 and with one or more corresponding power cables (i.e., arranged as a compound crossbow).

The preceding description and the examples shown in the drawings include two rails 101/102, two pairs of bow limbs 201/202, and two bowstrings 291/292. In other examples (not shown) of the multiple-shot crossbow 10, the mainframe 100 can further include at least one additional longitudinal rail (above the upper rail 102) with a corresponding longitudinal groove. The additional rail can be arranged to support an additional bolt with one vane of its fletching received within the groove, and to guide that additional bolt as it is launched from the multiple-shot crossbow. In such examples, the riser 200 can further include at least one additional longitudinal upper riser passage, to accommodate the bolt 92 on the upper rail 102, and the crossbow can further include (i) at least one additional pair of bow limbs attached to the riser 200 above the upper bow limbs 202, and (ii) at least one additional bowstring attached to the corresponding additional pair of bow limbs. The additional bow limbs and bowstring are arranged to be drawn, and then released (by a suitably arranged trigger mechanism 300) to launch a bolt positioned on the additional rail, in any suitable manner including those described above for the rail 101/102, bow limbs 201/202, bowstrings 291/292, and trigger mechanism 300. Various examples can be arranged for simultaneous loading and rapid firing of two, three, four, or more bolts, as needed or desired.

In addition to the preceding, the following example embodiments fall within the scope of the present disclosure or appended claims:

EXAMPLE 1

A crossbow comprising: (a) a mainframe including substantially parallel upper and lower longitudinal rails, each rail being arranged so as to support a corresponding bolt positioned thereon and to guide the corresponding bolt as the corresponding bolt is launched from the crossbow; (b) a riser attached to a front end of the mainframe, the riser including a longitudinal riser passage therethrough arranged so as to enable a bolt to be inserted through the riser passage, positioned on the lower rail, and subsequently launched from the crossbow; (c) upper and lower pairs of bow limbs attached to the riser, and corresponding upper and lower bowstrings attached to the upper and lower bow limbs, respectively, the bow limbs and bowstrings being arranged so that each bowstring can independently (i) be drawn from a corresponding brace position to a corresponding drawn position while deforming the corresponding bow limbs and (ii) return to the corresponding brace position and thereby launch a bolt positioned on the corresponding rail, the lower bowstring being movable between the corresponding brace and drawn positions within a longitudinal slot passing through the mainframe between the upper and lower rails; and (d) a trigger mechanism attached to a rear end of the mainframe and including (i) an upper trigger portion arranged so as to retain the upper bowstring in the corresponding drawn position and release, upon actuation by a user, the upper bowstring to return to the corresponding brace position, and (ii) a lower trigger portion arranged so as to retain the lower bowstring in the corresponding drawn position and release, upon actuation by the user, the lower bowstring to return to the corresponding brace position.

EXAMPLE 2

The crossbow of Example 1 wherein each rail includes a corresponding longitudinal groove arranged so as to (i) support a corresponding bolt positioned on the corresponding rail with one vane of fletching of the corresponding bolt received within the corresponding groove and (ii) guide the corresponding bolt as the corresponding bolt is launched from the crossbow;

EXAMPLE 3

The crossbow of any one of Examples 1 or 2 wherein the riser passage includes a central hole arranged so as to accommodate a shaft of a bolt inserted through the riser passage and three radial slots arranged so as to accommodate fletching of the bolt inserted through the riser passage.

EXAMPLE 4

The apparatus of any one of Examples 1 through 3 wherein the riser includes a longitudinal upper riser passage therethrough arranged so as to enable a bolt to be inserted through the upper riser passage, positioned on the upper rail, and subsequently launched from the crossbow.

EXAMPLE 5

The crossbow of Example 4 wherein the upper riser passage includes a central hole arranged so as to accommodate a shaft of a bolt inserted through the upper riser passage and three radial slots arranged so as to accommodate fletching of the bolt inserted through the upper riser passage.

EXAMPLE 6

The crossbow of any one of Examples 1 through 5 wherein the mainframe includes an enclosure above the upper rail, the upper bowstring being movable within a longitudinal slot between the enclosure and the upper rail.

EXAMPLE 7

The crossbow of any one of Examples 1 through 6 wherein the trigger mechanism includes a single safety mechanism movable between (i) a safety-on position that prevents actuation of the trigger mechanism and (ii) a safety-off position that allows actuation of the trigger mechanism.

EXAMPLE 8

The crossbow of any one of Examples 1 through 6 wherein the trigger mechanism includes upper and lower safety mechanisms, each safety mechanism being movable between (i) a corresponding safety-on position that prevents actuation of a corresponding portion of the trigger mechanism and (ii) a corresponding safety-off position that allows actuation of the corresponding portion of the trigger mechanism.

EXAMPLE 9

The crossbow of Example 8 wherein each safety mechanism is movable between the corresponding safety-on and safety-off positions independently of the other safety mechanism.

EXAMPLE 10

The crossbow of Example 8 wherein the upper and lower safety mechanisms are coupled together so that (i) with the upper safety mechanism in the safety-on position the lower safety mechanism is in the safety-on position and (ii) with the upper safety mechanism in the safety-off position the lower safety mechanism is in the safety-off position.

EXAMPLE 11

The crossbow of Example 8 wherein the upper and lower safety mechanisms are coupled together so that (i) with the upper safety mechanism in the safety-on position the lower safety mechanism is in the safety-off position or (ii) with the upper safety mechanism in the safety-off position the lower safety mechanism is in the safety-on position.

EXAMPLE 12

The crossbow of any one of Examples 1 through 11 wherein the trigger mechanism includes (i) upper and lower string catches, each movable between corresponding retention and release positions and biased toward the corresponding release position, each retaining the corresponding drawn bowstring while in the corresponding retention position, and each releasing the corresponding drawn bowstring upon biased movement to the corresponding release position, (ii) upper and lower sears, each movable between corresponding firing and non-firing positions and biased toward the corresponding non-firing position, each holding the corresponding string catch in the corresponding retention position while in the corresponding non-firing position, and each permitting biased movement of the corresponding string catch to the corresponding release position upon movement to the corresponding firing position, and (iii) upper and lower trigger actuators, each movable between corresponding actuating and non-actuating positions, each linked to the corresponding sear so as to move the corresponding sear to the corresponding firing position upon movement from the corresponding non-actuated position to the corresponding actuated position.

EXAMPLE 13

The crossbow of Example 12 wherein the trigger mechanism is arranged so as to enable independent actuation of each of the upper trigger actuator and the lower trigger actuator to release independently the corresponding bowstring in response to actuation of the corresponding trigger actuator.

EXAMPLE 14

The crossbow of Example 12 wherein the trigger mechanism is arranged so that a single trigger actuator acts as both of the upper and lower trigger actuators, or the upper and lower trigger actuator are coupled together to act as a single trigger actuator, and further arranged so as to enable only one of (i) release of both upper and lower bowstrings together in response to a single actuation of the single trigger actuator, (ii) release of the upper and lower bowstrings sequentially in response to a single actuation of the single trigger actuator, or (iii) release of the upper and lower bowstrings sequentially in response to two sequential actuations of the single trigger actuator.

EXAMPLE 15

The crossbow of Example 12 wherein the trigger mechanism is arranged so that a single trigger actuator acts as both of the upper and lower trigger actuators, or the upper and lower trigger actuator are coupled together to act as a single trigger actuator, and further arranged so as to enable switching among two or more of (i) an arrangement that enables release of both upper and lower bowstrings together in response to a single actuation of the single trigger actuator, (ii) an arrangement that enables release of the upper and lower bowstrings sequentially in response to a single actuation of the single trigger actuator, or (iii) an arrangement that enables release of the upper and lower bowstrings sequentially in response to two sequential actuations of the single trigger actuator.

EXAMPLE 16

The crossbow of any one of Examples 12 through 15 wherein the trigger mechanism is arranged so as to enable switching between (i) an arrangement that enables independent actuation of each of the upper trigger actuator and the lower trigger actuator to release independently the corresponding bowstring in response to actuation of the corresponding trigger actuator, and (ii) an arrangement wherein the upper and lower trigger actuators are coupled together so as to enable release of both of the upper and lower bowstrings in response to actuation of either trigger actuator.

EXAMPLE 17

The crossbow of any one of Examples 1 through 16 wherein the trigger mechanism includes upper and lower anti-dry-fire mechanisms, each arranged so as to (i) prevent movement of the corresponding bowstring from the corresponding drawn position without a bolt present on the corresponding rail, and (ii) permit movement of the corresponding bowstring from the corresponding drawn position to the corresponding brace position only with a bolt present on the corresponding rail.

EXAMPLE 18

The crossbow of Example 17 wherein: (a) each anti-dry-fire mechanism includes a corresponding string latch movable between a corresponding bolt-absent position and a corresponding bolt-present position and biased toward the bolt-absent position; (b) with the corresponding bowstring in the corresponding drawn position and with no bolt positioned on the corresponding rail, the corresponding string latch is held by bias force thereon in the corresponding bolt-absent position and prevents movement of the corresponding bowstring to the corresponding brace position; and (c) with the corresponding bowstring in the corresponding drawn position and with a bolt positioned on the corresponding rail, the bolt holds the corresponding string latch in the corresponding bolt-present position against bias force thereon and permits movement of the corresponding bowstring to the corresponding brace position to launch the bolt positioned on the corresponding rail.

EXAMPLE 19

The crossbow of any one of Examples 1 through 18 wherein the trigger mechanism includes upper and lower anti-dry-fire mechanisms, each arranged so as to (i) prevent actuation of the corresponding trigger portion of the trigger mechanism without a bolt present on the corresponding rail, and (ii) permit actuation of the corresponding trigger portion of the trigger mechanism only with a bolt present on the corresponding rail.

EXAMPLE 20

The crossbow of Example 19 wherein: (a) each anti-dry-fire mechanism includes (i) a corresponding bolt sensor movable between a corresponding bolt-absent position and a corresponding bolt-present position, and (ii) a corresponding reciprocating sear latch movable between a corresponding latched position and a corresponding unlatched position and biased toward the corresponding latched position; (b) each bolt sensor is coupled to the corresponding sear latch so that (i) with the bolt sensor in the corresponding bolt-absent position, the corresponding sear latch is held in the corresponding latched position by bias force thereon, and (ii) with the bolt sensor held in the corresponding bolt present position, the corresponding sear latch is held in the corresponding unlatched position against the bias force thereon; (c) with the corresponding bowstring in the corresponding drawn position and with no bolt positioned on the corresponding rail, the corresponding bolt sensor is in the corresponding bolt-absent position, and the corresponding sear latch is held by the bias force thereon in the corresponding latched position and prevents movement of the corresponding sear and actuation of the corresponding trigger portion; and (d) with the corresponding bowstring in the corresponding drawn position and with a bolt positioned on the corresponding rail, the corresponding bolt sensor is held in the corresponding bolt-present position, and the corresponding sear latch is held against the bias force thereon in the corresponding unlatched position and permits movement of the corresponding sear and actuation of the corresponding trigger portion.

EXAMPLE 21

The crossbow of Example 20 wherein each trigger portion includes a biased bolt retainer positioned and arranged so that, with a bolt present on the corresponding rail, the bolt retainer presses the bolt against the corresponding bolt sensor.

EXAMPLE 22

The crossbow of Example 21 wherein each bolt retainer is structurally arranged to frictionally engage the corresponding bolt positioned on the corresponding rail.

EXAMPLE 23

The crossbow of Example 22 wherein each bolt retainer includes an engagement surface with rounded or beveled front and back portions structurally arranged for facilitating movement of the corresponding bolt along the corresponding rail.

EXAMPLE 24

The crossbow of any one of Examples 1 through 23 further comprising a mounting bracket for a sight, the mounting bracket being attached to a rearward portion of the mainframe and being movable between defined upper and lower sight positions, wherein (i) alignment of a sight mounted on the mounting bracket, with respect to a flight path of a bolt launched from the upper rail and with the mounting bracket in the upper sight position, results in equivalent alignment of the sight, with the mounting bracket in the lower sight position, with respect to a flight path of a bolt launched from the lower rail, or (ii) alignment of the mounted sight, with respect to the flight path of a bolt launched from the lower rail and with the mounting bracket in the lower sight position, results in equivalent alignment of the sight, with the mounting bracket in the upper sight position, with respect to the flight path of a bolt launched from the upper rail.

EXAMPLE 25

The crossbow of any one of Examples 1 through 24 wherein at least one pair of bow limbs is arranged as a pair of recurve bow limbs.

EXAMPLE 26

The crossbow of any one of Examples 1 through 25 further comprising a corresponding pulley member rotatably mounted each of at least one pair of bow limbs and engaged with a corresponding one of the bowstrings and with one or more corresponding power cables.

EXAMPLE 27

The crossbow of any one of Examples 1 through 26 wherein: (a') the mainframe further includes at least one additional longitudinal rail above the upper rail that is arranged so as to support a corresponding bolt positioned thereon and to guide the corresponding bolt as the corresponding bolt is launched from the crossbow; (b') the riser further includes at least one additional longitudinal upper riser passage therethrough arranged so as to enable a bolt to be inserted through the additional riser passage, positioned on the upper or additional rail, and subsequently launched from the crossbow; (c') the crossbow further includes at least one additional pair of bow limbs attached to the riser above the upper bow limbs and at least one additional bowstring attached to the corresponding additional pair of bow limbs and arranged to (i) be drawn from a corresponding brace position to a corresponding drawn position while deforming the corresponding additional pair of bow limbs and (ii) return to the corresponding brace position and thereby launch a bolt positioned on the corresponding additional rail, the upper bowstring being movable within a longitudinal slot between the additional and upper rails; and (d') the trigger mechanism is further arranged at a so as to retain the additional bowstring in the corresponding drawn position and release, upon actuation by a user, the additional bowstring to return to the corresponding brace position.

EXAMPLE 28

A trigger assembly for a crossbow, the trigger assembly comprising: (a) a string catch movable retention and release positions and biased toward the release position, the string catch being arranged to as to (i) retain a drawn bowstring of the crossbow while in the corresponding retention position, and (ii) release the drawn bowstring upon biased movement to the release position; (b) a sear movable between firing and non-firing positions and biased toward the corresponding non-firing position, the sear being arranged so as to hold the string catch in the retention position while in the non-firing position, and to permit biased movement of the string catch to the release position upon movement to the firing position; (c) a trigger actuator movable between corresponding actuating and non-actuating positions, the trigger actuator being linked to the sear so as to move the sear to the firing position upon movement from the non-actuated position to the actuated position; and (d) an anti-dry-fire mechanism arranged so as to (i) prevent movement of the trigger actuator to the actuated position without a bolt present on a rail of the crossbow, and (ii) permit movement of the trigger actuator to the actuated position only with a bolt present on the rail, wherein: (e) the anti-dry-fire mechanism includes (i) a bolt sensor movable between a bolt-absent position and a bolt-present position, and (ii) a reciprocating sear latch movable between a latched position and an unlatched position and biased toward the latched position; (f) the bolt sensor is coupled to the sear latch so that (i) with the bolt sensor in the bolt-absent position, the sear latch is held in the latched position by bias force thereon, and (ii) with the bolt sensor held in the bolt present position, the sear latch is held in the unlatched position against the bias force thereon; (g) with the drawn bowstring retained by the string catch and with no bolt positioned on the rail, the bolt sensor is in the bolt-absent position, and the sear latch is held by the bias force thereon in the latched position and prevents movement of the sear and movement of the trigger actuator to the actuated position; and (h) with the draw bowstring retained by the string catch and with a bolt positioned on the rail, the bolt sensor is held in the bolt-present position, and the sear latch is held against the bias force thereon in the unlatched position and permits movement of the sear and movement of the trigger actuator to the actuated position.

EXAMPLE 29

The trigger assembly of Example 28 wherein the trigger assembly includes a biased bolt retainer positioned and arranged so that, with a bolt present on the rail, the bolt retainer presses the bolt against the bolt sensor.

EXAMPLE 30

The crossbow of Example 29 wherein the bolt retainer is structurally arranged to frictionally engage the bolt positioned on the rail.

EXAMPLE 31

The crossbow of Example 30 wherein the bolt retainer includes an engagement surface with rounded or beveled front and back portions structurally arranged for facilitating movement of the bolt along the rail.

EXAMPLE 32

The trigger assembly of any one of Examples 28 through 31 further comprising a safety mechanism movable between (i) a safety-on position that prevents actuation of the trigger assembly and (ii) a safety-off position that allows actuation of the trigger assembly.

It is intended that equivalents of the disclosed example embodiments and methods shall fall within the scope of the present disclosure or appended claims. It is intended that the disclosed example embodiments and methods, and equivalents thereof, may be modified while remaining within the scope of the present disclosure or appended claims.

In the foregoing Detailed Description, various features may be grouped together in several example embodiments for the purpose of streamlining the disclosure. This method of disclosure is not to be interpreted as reflecting an intention that any claimed embodiment requires more features than are expressly recited in the corresponding claim. Rather, as the appended claims reflect, inventive subject matter may lie in less than all features of a single disclosed example embodiment. Therefore the present disclosure shall be construed as implicitly disclosing any embodiment having any suitable subset of one or more features—which features are shown, described, or claimed in the present application—including those subsets that may not be explicitly disclosed herein. A "suitable" subset of features includes only features that are neither incompatible nor mutually exclusive with respect to any other feature of that subset. Accordingly, the appended claims are hereby incorporated into the Detailed Description, with each claim standing on its own as a separate disclosed embodiment. In addition, each of the appended dependent claims shall be interpreted, only for purposes of disclosure by said incorporation of the claims into the Detailed Description, as if written in multiple dependent form and dependent upon all preceding claims with which it is not inconsistent. It should be further noted that the cumulative scope of the appended claims can, but does not necessarily, encompass the whole of the subject matter disclosed in the present application.

The following interpretations shall apply for purposes of the present disclosure and appended claims. The words "comprising," "including," "having," and variants thereof, wherever they appear, shall be construed as open-ended terminology, with the same meaning as if a phrase such as "at least" were appended after each instance thereof, unless explicitly stated otherwise. The article "a" shall be interpreted as "one or more" unless "only one," "a single," or other similar limitation is stated explicitly or is implicit in the particular context; similarly, the article "the" shall be interpreted as "one or more of the" unless "only one of the," "a single one of the," or other similar limitation is stated explicitly or is implicit in the particular context. The conjunction "or" is to be construed inclusively (e.g., "a dog or a cat" would be interpreted as "a dog, or a cat, or both"; e.g., "a dog, a cat, or a mouse" would be interpreted as "a dog, or a cat, or a mouse, or any two, or all three"), unless: (i) it is explicitly stated otherwise, e.g., by use of "either . . . or," "only one of," or similar language; or (ii) two or more of the listed alternatives are mutually exclusive within the particular context, in which case "or" would encompass only those combinations involving non-mutually-exclusive alternatives. Similarly, "one or more of a dog or a cat" would be interpreted as including (i) one or more dogs without any cats, (ii) one or more cats without any dogs, or (iii) one or more dogs and one or more cats, unless explicitly stated otherwise or the alternatives are understood or disclosed (implicitly or explicitly) to be mutually exclusive or incompatible. Similarly, "one or more of a dog, a cat, or a mouse" would be interpreted as (i) one or more dogs without any cats or mice, (ii) one or more cats without and dogs or mice, (iii) one or more mice without any dogs or cats, (iv) one or more dogs and one or more cats without any mice, (v) one or more dogs and one or more mice without any cats, (vi) one or more cats and one or more mice without any dogs, or (vii) one or more dogs, one or more cats, and one or more mice. "Two or more of a dog, a cat, or a mouse" would be interpreted as (i) one or more dogs and one or more cats without any mice, (ii) one or more dogs and one or more mice without any cats, (iii) one or more cats and one or more mice without and dogs, or (iv) one or more dogs, one or more cats, and one or more mice; "three or more," "four or more," and so on would be analogously interpreted. For any of the preceding recitations, if any pairs or combinations of the included alternatives are understood or disclosed (implicitly or explicitly) to be incompatible or mutually exclusive, such pairs or combinations are understood to be excluded from the corresponding recitation.

For purposes of the present disclosure or appended claims, when terms are employed such as "about equal to," "substantially equal to," "greater than about," "less than about," and so forth, in relation to a numerical quantity, standard conventions pertaining to measurement precision and significant digits shall apply, unless a differing interpretation is explicitly set forth. For null quantities described by phrases such as "substantially prevented," "substantially absent," "substantially eliminated," "about equal to zero," "negligible," and so forth, each such phrase shall denote the case wherein the quantity in question has been reduced or diminished to such an extent that, for practical purposes in the context of the intended operation or use of the disclosed or claimed apparatus or method, the overall behavior or performance of the apparatus or method does not differ from that which would have occurred had the null quantity in fact been completely removed, exactly equal to zero, or otherwise exactly nulled.

For purposes of the present disclosure and appended claims, any labelling of elements, steps, limitations, or other portions of an embodiment, example, or claim (e.g., first, second, third, etc., (a), (b), (c), etc., or (i), (ii), (iii), etc.) is only for purposes of clarity, and shall not be construed as implying any sort of ordering or precedence of the portions so labelled. If any such ordering or precedence is intended, it will be explicitly recited in the embodiment, example, or claim or, in some instances, it will be implicit or inherent based on the specific content of the embodiment, example, or claim. In the appended claims, if the provisions of 35 USC § 112(f) are desired to be invoked in an apparatus claim, then the word "means" will appear in that apparatus claim. If those provisions are desired to be invoked in a method claim, the words "a step for" will appear in that method claim. Conversely, if the words "means" or "a step for" do not appear in a claim, then the provisions of 35 USC § 112(f) are not intended to be invoked for that claim.

If any one or more disclosures are incorporated herein by reference and such incorporated disclosures conflict in part or whole with, or differ in scope from, the present disclosure, then to the extent of conflict, broader disclosure, or broader definition of terms, the present disclosure controls. If such incorporated disclosures conflict in part or whole with one another, then to the extent of conflict, the later-dated disclosure controls.

The Abstract is provided as required as an aid to those searching for specific subject matter within the patent literature. However, the Abstract is not intended to imply that any elements, features, or limitations recited therein are necessarily encompassed by any particular claim. The scope of subject matter encompassed by each claim shall be determined by the recitation of only that claim.

What is claimed is:

1. A multiple-trigger assembly trigger mechanism for a crossbow, the trigger mechanism comprising:

(a) a first trigger assembly comprising:

(i) a first string catch movable between retention and release positions and biased toward the release position, the first string catch being arranged so as to (1) retain a first drawn bowstring of the crossbow while in the retention position, and (2) release the first drawn bowstring upon biased movement to the release position;

(ii) a first sear movable between firing and non-firing positions and biased toward the non-firing position, the first sear being arranged so as to hold the first string catch in the retention position while in the non-firing position, and to permit biased movement of the first string catch to the release position upon movement to the firing position;

(iii) a first trigger actuator movable between actuated and non-actuated positions, the first trigger actuator being linked to the first sear so as to move the first sear to the firing position upon movement from the non-actuated position to the actuated position; and (iv) a first anti-dry-fire mechanism that includes (1) a first bolt sensor movable between a bolt-absent position and a bolt-present position, and (2) a linearly reciprocating first sear latch movable between a latched position and an unlatched position and biased toward the latched position;

(b) a second trigger assembly;

wherein:

(c) the first anti-dry-fire mechanism is arranged so as to (i) prevent movement of the first trigger actuator to the actuated position without a bolt present on a first rail of the crossbow, and (ii) permit movement of the first trigger actuator to the actuated position only with a bolt present on the first rail;

(d) the first bolt sensor is pivotably coupled to the first sear latch so that (i) with the first bolt sensor in the bolt-absent position, the first sear latch is held in the latched position by bias force thereon, and (ii) with the first bolt sensor held in the bolt-present position, the first sear latch is held in the unlatched position against the bias force thereon;

(e) with the first drawn bowstring retained by the first string catch and with no bolt positioned on the first rail, the first bolt sensor is in the bolt-absent position, and the first sear latch is held by the bias force thereon in the latched position and prevents movement of the first sear and movement of the first trigger actuator to the actuated position; and (f) with the first drawn bowstring retained by the first string catch and with a bolt positioned on the first rail, the first bolt sensor is held in the bolt-present position, and the first sear latch is held against the bias force thereon in the unlatched position and permits movement of the first sear and movement of the first trigger actuator to the actuated position.

2. The trigger mechanism of claim 1, wherein the second trigger assembly comprises:

(i) a second string catch movable between retention and release positions and biased toward the release position, the second string catch being arranged so as to (1) retain a second drawn bowstring of the crossbow while in the retention position, and (2) release the second drawn bowstring upon biased movement to the release position;

(ii) a second sear movable between firing and non-firing positions and biased toward the non-firing position, the second sear being arranged so as to hold the second string catch in the retention position while in the non-firing position, and to permit biased movement of the second string catch to the release position upon movement to the firing position;

(iii) a second trigger actuator movable between actuated and non-actuated positions, the second trigger actuator being linked to the second sear so as to move the second sear to the firing position upon movement from the non-actuated position to the actuated position;

(iv) a second anti-dry-fire mechanism arranged so as to (1) prevent movement of the second trigger actuator to the actuated position without a bolt present on a second rail of the crossbow, and (2) permit movement of the second trigger actuator to the actuated position only with a bolt present on the second rail; and wherein:

(g) the second anti-dry-fire mechanism includes (i) a second bolt sensor movable between a bolt-absent position and a bolt-present position, and (ii) a reciprocating second sear latch movable between a latched position and an unlatched position and biased toward the latched position;

(h) the second bolt sensor is coupled to the second sear latch so that (i) with the second bolt sensor in the bolt-absent position, the second sear latch is held in the latched position by bias force thereon, and (ii) with the second bolt sensor held in the bolt-present position, the second sear latch is held in the unlatched position against the bias force thereon;

(i) with the second drawn bowstring retained by the second string catch and with no bolt positioned on the second rail, the second bolt sensor is in the bolt-absent position, and the second sear latch is held by the bias force thereon in the latched position and prevents movement of the second sear and movement of the second trigger actuator to the actuated position; and (j) with the second drawn bowstring retained by the second string catch and with a bolt positioned on the second rail, the second bolt sensor is held in the bolt-present position, and the second sear latch is held against the bias force thereon in the unlatched position and permits movement of the second sear and movement of the second trigger actuator to the actuated position.

3. The trigger mechanism of claim 2, wherein the trigger mechanism is arranged so as to enable independent actuation of each of the first trigger actuator and the second trigger actuator to release independently the corresponding bowstring in response to actuation of the corresponding trigger actuator.

4. The trigger mechanism of claim 2, wherein the trigger mechanism is arranged so that a single trigger actuator acts as both of the first and second trigger actuators, or the first and second trigger actuator are coupled together to act as a single trigger actuator, and further arranged so as to enable switching among two or more of (i) release of both first and second bowstrings together in response to a single actuation of the single trigger actuator, (ii) release of the first and second bowstrings sequentially in response to a single actuation of the single trigger actuator, or (iii) release of the first and second bowstrings sequentially in response to two sequential actuations of the single trigger actuator.

5. The trigger mechanism of claim 2, wherein the trigger mechanism is arranged so as to enable switching between (i) an arrangement that enables independent actuation of each of the first trigger actuator and the second trigger actuator to release independently the corresponding bowstring in response to actuation of the corresponding trigger actuator, and (ii) an arrangement wherein the first and second trigger actuators are coupled together so as to enable release of both of the first and second bowstrings in response to actuation of either trigger actuator.

6. A trigger assembly for a crossbow, the trigger assembly comprising:

(a) a string catch movable between retention and release positions and biased toward the release position, the string catch being arranged so as to (i) retain a drawn bowstring of the crossbow while in the retention position, and (ii) release the drawn bowstring upon biased movement to the release position;

(b) a sear movable between firing and non-firing positions and biased toward the non-firing position, the sear being arranged so as to hold the string catch in the retention position while in the non-firing position, and to permit biased movement of the string catch to the release position upon movement to the firing position;

(c) a trigger actuator movable between actuated and non-actuated positions, the trigger actuator being linked to the sear so as to move the sear to the firing position upon movement from the non-actuated position to the actuated position; and (d) an anti-dry-fire mechanism arranged so as to (i) prevent movement of the trigger actuator to the actuated position without a bolt present on a rail of the crossbow, and (ii) permit movement of the trigger actuator to the actuated position only with a bolt present on the rail;

wherein:

(e) the anti-dry-fire mechanism includes (i) a bolt sensor movable between a bolt-absent position and a bolt-present position, and (ii) a linearly reciprocating sear latch movable between a latched position and an unlatched position and biased toward the latched position;

(f) the bolt sensor is pivotably coupled to the sear latch so that (i) with the bolt sensor in the bolt-absent position, the sear latch is held in the latched position by bias force thereon, and (ii) with the bolt sensor held in the bolt-present position, the sear latch is held in the unlatched position against the bias force thereon;

(g) with the drawn bowstring retained by the string catch and with no bolt positioned on the rail, the bolt sensor is in the bolt-absent position, and the sear latch is held by the bias force thereon in the latched position and prevents movement of the sear and movement of the trigger actuator to the actuated position; and (h) with the draw bowstring retained by the string catch and with a bolt positioned on the rail, the bolt sensor is held in the bolt-present position, and the sear latch is held against the bias force thereon in the unlatched position and permits movement of the sear and movement of the trigger actuator to the actuated position.

7. The trigger assembly of claim 6, wherein the trigger assembly includes a biased bolt retainer positioned and arranged so that, with a bolt present on the rail, the bolt retainer presses the bolt against the bolt sensor.

8. The trigger assembly of claim 7, wherein the bolt retainer is structurally arranged to frictionally engage the bolt positioned on the rail.

9. A trigger assembly for a crossbow, the trigger assembly comprising:

(a) an anti-dry-fire mechanism that includes (i) a bolt sensor movable between a bolt-absent position and a bolt-present position, and (ii) a linearly reciprocating sear latch movable between a latched position and an unlatched position and biased toward the latched position;

wherein:

(b) the bolt sensor is pivotably coupled to the sear latch so that (i) with the bolt sensor in the bolt-absent position, the sear latch is held in the latched position by bias force thereon, and (ii) with the bolt sensor held in the bolt-present position, the sear latch is held in the unlatched position against the bias force thereon;

(c) the sear latch prevents movement of a sear when the sear latch is in the latched position.

10. The trigger assembly of claim 9, wherein:

(a) with no bolt positioned on a rail of the crossbow, the bolt sensor is in the bolt-absent position, and the sear latch is held by the bias force thereon in the latched position and prevents movement of a sear and movement of a trigger actuator to an actuated position; and (b) with a bolt positioned on the rail of the crossbow, the bolt sensor is held in the bolt-present position, and the sear latch is held against the bias force thereon in the unlatched position and permits movement of the sear and movement of the trigger actuator to the actuated position.

11. The trigger assembly of claim 9, wherein the trigger assembly includes a biased bolt retainer positioned and arranged so that, with a bolt positioned on a rail of the crossbow, the bolt retainer presses the bolt against the bolt sensor.

12. The trigger assembly of claim 11, wherein the bolt retainer is structurally arranged to frictionally engage the bolt positioned on the rail.

* * * * *